US008702298B2

(12) United States Patent
Sei

(10) Patent No.: US 8,702,298 B2
(45) Date of Patent: Apr. 22, 2014

(54) INNER-CIRCULATION EMULSIFYING AND DISPERSING ARRANGEMENT

(76) Inventor: Chugen Sei, Tokyo (JP)

( * ) Notice: Subject to any disclaimer, the term of this patent is extended or adjusted under 35 U.S.C. 154(b) by 919 days.

(21) Appl. No.: 12/604,341

(22) Filed: Oct. 22, 2009

(65) Prior Publication Data

US 2010/0103767 A1 Apr. 29, 2010

(30) Foreign Application Priority Data

Oct. 23, 2008 (JP) ..... 2008-273489

(51) Int. Cl.
*B01F 5/06* (2006.01)
*B01F 7/04* (2006.01)

(52) U.S. Cl.
USPC ..... 366/136; 366/293; 366/303; 366/304; 366/325.4

(58) Field of Classification Search
USPC ..... 366/302, 303, 304, 306, 307, 164.4, 366/290, 285, 286, 293, 325.4, 136, 137
See application file for complete search history.

(56) References Cited

U.S. PATENT DOCUMENTS

| | | | | |
|---|---|---|---|---|
| 2,477,929 | A | 8/1949 | Hetherington | |
| 2,961,223 | A * | 11/1960 | Dooley | 366/76.6 |
| 4,834,542 | A * | 5/1989 | Sherwood | 366/21 |
| 6,866,411 | B1 * | 3/2005 | Stelzer et al. | 366/136 |
| 7,090,391 | B2 * | 8/2006 | Taniguchi | 366/118 |
| 7,637,651 | B2 * | 12/2009 | Bush et al. | 366/136 |
| 7,749,481 | B2 * | 7/2010 | Hassan et al. | 423/576.4 |
| 7,842,184 | B2 * | 11/2010 | Hassan et al. | 210/600 |
| 7,906,011 | B2 * | 3/2011 | Burris et al. | 208/22 |
| 8,079,752 | B2 * | 12/2011 | Rausch et al. | 366/178.2 |
| 8,080,684 | B2 * | 12/2011 | Hassan et al. | 560/231 |
| 2007/0025178 | A1 * | 2/2007 | Kao et al. | 366/136 |
| 2009/0005552 | A1 * | 1/2009 | Hassan et al. | 536/102 |
| 2010/0004419 | A1 * | 1/2010 | Hassan et al. | 526/351 |
| 2010/0103767 | A1 * | 4/2010 | Chugen | 366/164.4 |
| 2010/0111786 | A1 * | 5/2010 | Hassan et al. | 422/225 |

FOREIGN PATENT DOCUMENTS

| | | | | |
|---|---|---|---|---|
| DE | 41 37 179 | | 5/1993 | |
| EP | 0 667 386 | | 8/1995 | |
| EP | 673677 | A1 * | 9/1995 | B01F 7/00 |
| EP | 0 898 083 | | 2/1999 | |
| FR | 2 776 342 | | 9/1999 | |
| JP | 50-148343 | | 5/1974 | |
| JP | 2-256068 | | 10/1990 | |
| JP | 5-26138 | | 4/1993 | |
| JP | 2002-304004 | | 10/2002 | |
| JP | 2008-114151 | | 5/2008 | |
| WO | 93/11360 | | 6/1993 | |
| WO | WO 9409894 | A1 * | 5/1994 | B01F 7/00 |

OTHER PUBLICATIONS

EPO Communication dated Mar. 15, 2011, including Search and Examination Report (from counterpart European Patent Application No. EP 09 17 3991).

* cited by examiner

*Primary Examiner* — Tony G Soohoo
(74) *Attorney, Agent, or Firm* — Minder Law Group; Willy H. Wong

(57) ABSTRACT

An emulsifying and dispersing arrangement is provided, in which a handled material undergoes multi-time handling and a dispersion process, for achieving dispersion characteristics exhibiting uniformity of particle size. In addition, the temperature generated in the arrangement is controllable.

20 Claims, 3 Drawing Sheets

INNER-CIRCULATION EMULSIFYING AND DISPERSING ARRANGEMENT

The present application claims priority based on Japanese Patent Application No. 2008-273489 filed on Oct. 23, 2008. The full disclosure of Japanese Patent Application No. 2008-273489 is hereby expressly incorporated by reference into the present specification. In the event of any errors in translation, or other conflicts, if any, between the present specification and Japanese Patent Application No. 2008-273489, the Japanese application shall be considered controlling.

BACKGROUND OF THE INVENTION

1. Field of the Invention

The present invention relates to technologies concerned with arrangements for rotary emulsifying and dispersing.

2. Description of the Related Art

Rotary emulsifying and dispersing arrangements are widely used in industry. Previously used arrangements commonly contain a suction inlet like that of a centrifugal water pump, and in a casing contains impellers on the rotor thereof, similar to the impellers of a centrifugal water pump. The handled material is sucked into the casing upon turning of a rotor, and then the material is spiraled away from the rotor and hits upon a stator, which is set outside of the rotor, after achieving a given centrifugal power from the impellers of the rotor. The material finally is emulsified, dispersed and agitated, and is discharged from an outlet under pressure from the centrifugal power.

In order to achieve a dispersion property having a uniform granular size, the rotor and stator either are constructed as a multi-stage type, like that of a multi-stage pump, or are constructed so as to connect the suction inlet in the dispersing arrangement with a retrieval tank into which the material is dischargeable, so that the material can be redirected into the arrangement, and be treated a plurality of times and thus achieve a uniform granular size. However, when a multi-stage rotor is applied, high pressure will occur similar to multi-stage pumping functions. Therefore, reasonably, cooling water for a mechanical seal in such an arrangement should be highly pressurized, and an auxiliary supercharging pump, which is used for pressuring the arrangement, is a must. Also, redirection of material from the retrieval tank into the arrangement makes the system an open system. Thus, it is difficult to achieve a continuous process, as in a closed system.

SUMMARY OF THE INVENTION

An object of the present invention is to provide a dispersing arrangement, in which a material can achieve and undergo random multi-time handling in a continuous process, in a closed loop system, without generating high pressure.

In order to achieve the above object, the rotary emulsifying and dispersing arrangement functions in a similar manner as a centrifugal water pump, because centrifugal power is generated by turning of a rotor. The principles of a previously used dispersion arrangement are shown in FIG. 3, whereas the principles of the present invention are shown in FIG. 1. A flow channel 6, which runs through a stator 2, is constructed in front of the first stator 2-2 in the casing 5 of the arrangement, so that the handled material, which is discharged from the last rotor 1-1, can be redirected into the suction inlet via the flow channel 6, whereupon depressurizing at the suction inlet is achieved.

EFFECTS OF THE INVENTION

As mentioned above, the handled material, which is discharged from the last rotor 1-1, becomes depressurized at the suction inlet in the first rotor 1-2 via the flow channel 6, which is configured so as to run through the stator in front of the first stator 2-2 in the casing 5. By adjusting the clearance of the flow channel 6, the pressure that occurs in the casing 5 of the dispersing arrangement also can be adjusted. Furthermore, a uniform particle size can be achieved in the handled material, which is discharged from the last rotor 1-1, and the handled material undergoes reagitation and redispersion, thereby acquiring improved properties of dispersion.

DETAILED DESCRIPTION OF THE PREFERRED EMBODIMENT

Figure 4:
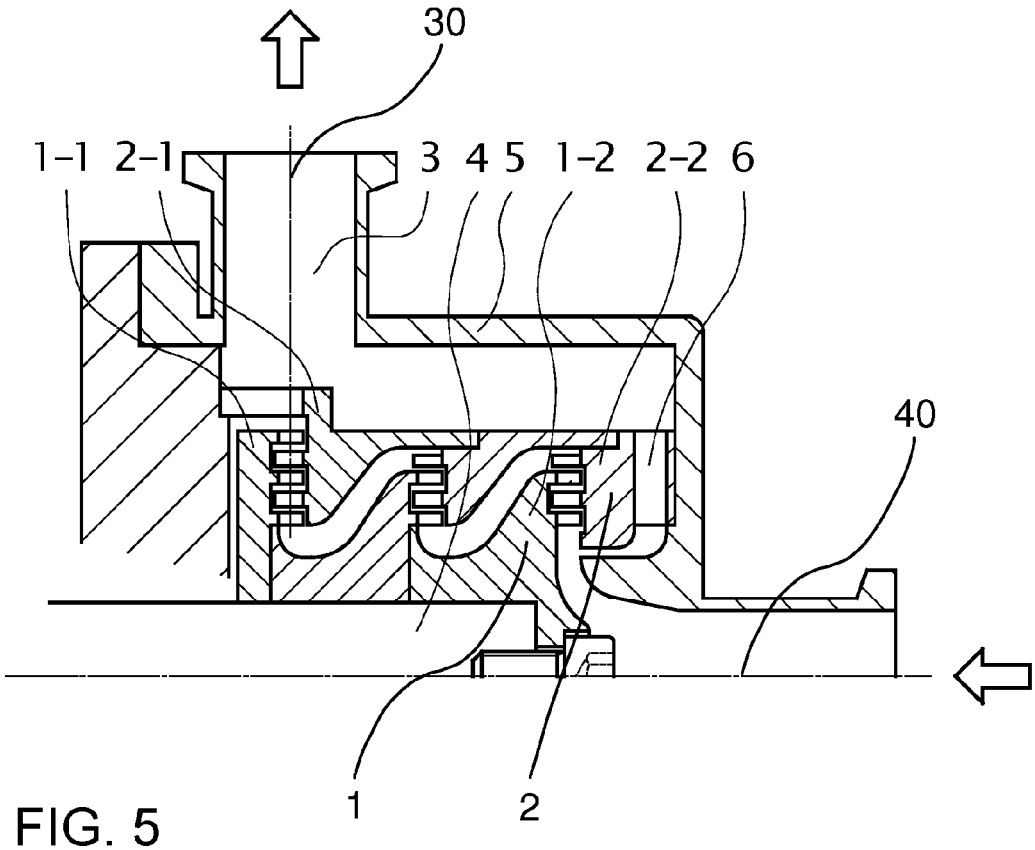
FIG. 4 is a structural view of the present invention.
Figure 6:
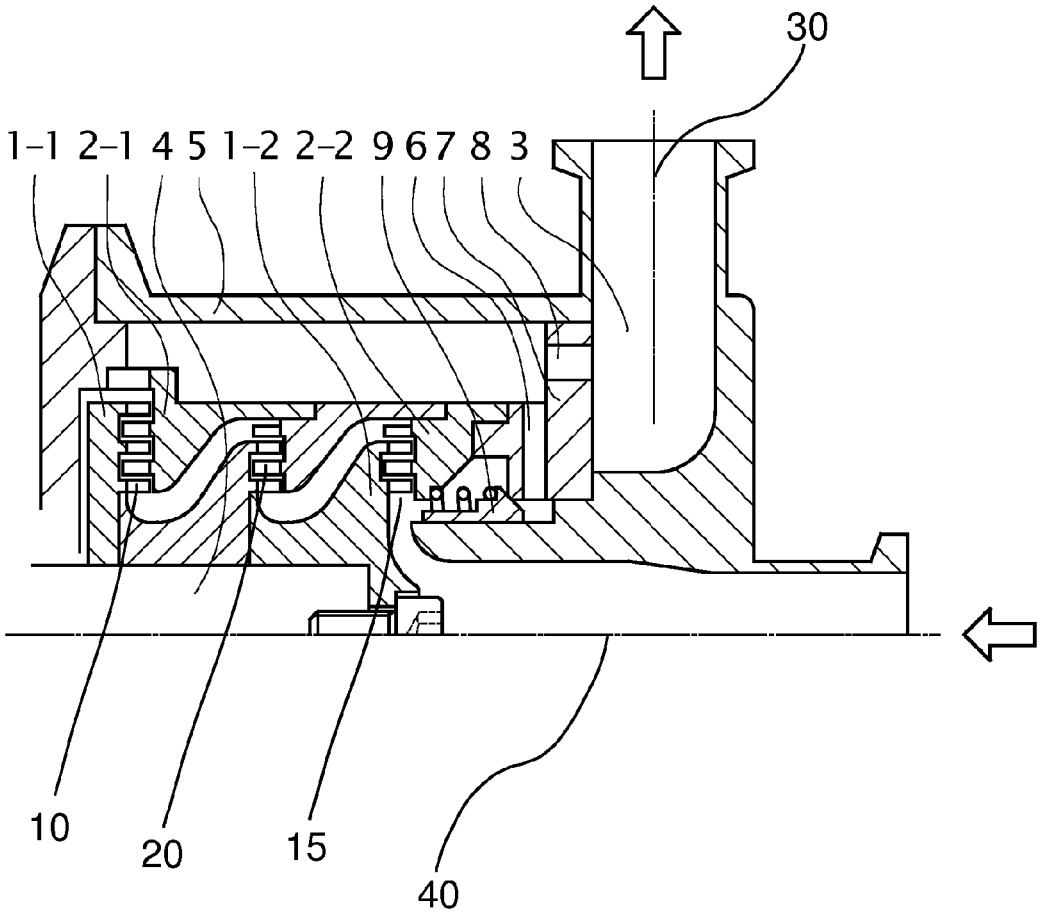
FIG. 6 is a structural view showing placement of a check valve 9 in the present invention.

As shown in FIG. 4, the present invention is constituted by a casing 5 that is situated firmly on a base, fixed stators 2, an outlet 3 having an outlet axis 30, a freely-turnable shaft 4 having a shaft axis 40, and rotors 1 that turn together with the shaft 4. Also, the handled material, which is discharged from the last rotor 1-1, is redirected into the suction inlet in the first rotor 1-2 via a flow channel 6, which is constructed so as to run through the stator prior to the first stator 2-2 in the casing 5. By adjusting the clearance of the flow channel 6, the pressure that occurs in the casing 5 of the arrangement can also be adjusted. As shown in FIG. 6, apertures 15 between the rotors 1 and the stators 2 extend radially from the shaft axis 40. Rotor outshoots 10 extend from the rotors 1 and are generally parallel to shaft axis 40. Similarly, stator outshoots 20 extend from the stators 2 and are generally parallel to shaft axis 40.

Figure 1:
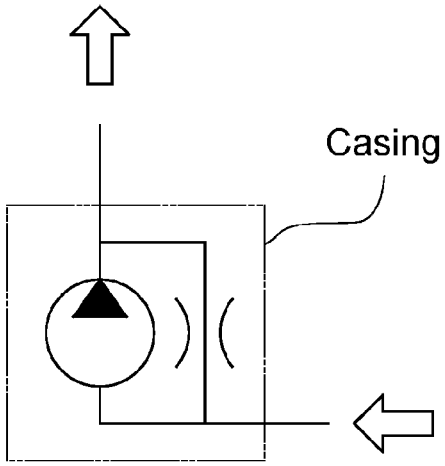
FIG. 1 shows a concerned principle view of the present invention.
Figure 2:
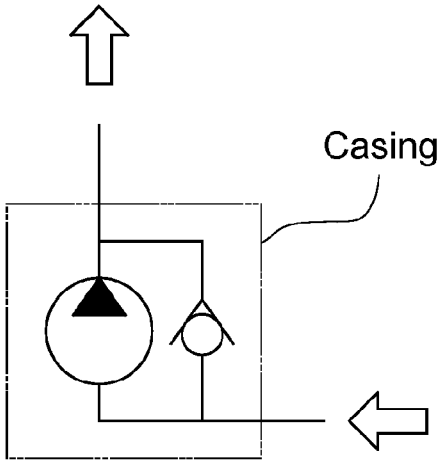
FIG. 2 is a principle view showing placement of a check valve in the present invention.
Figure 3:
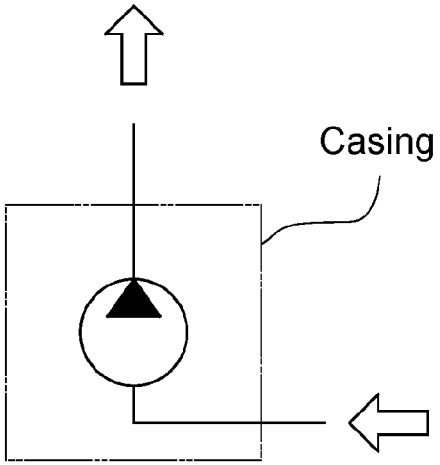
FIG. 3 is a principle view of a conventional and previously used emulsifying and dispersing arrangement.

The flow channel 6 in the inner-circulation emulsifying and dispersing arrangement can also include a check valve 9, as shown in FIG. 6, in order to control the pressure inside the casing 5. FIG. 2 is a schematic structural illustration showing such an arrangement.

Figure 5:
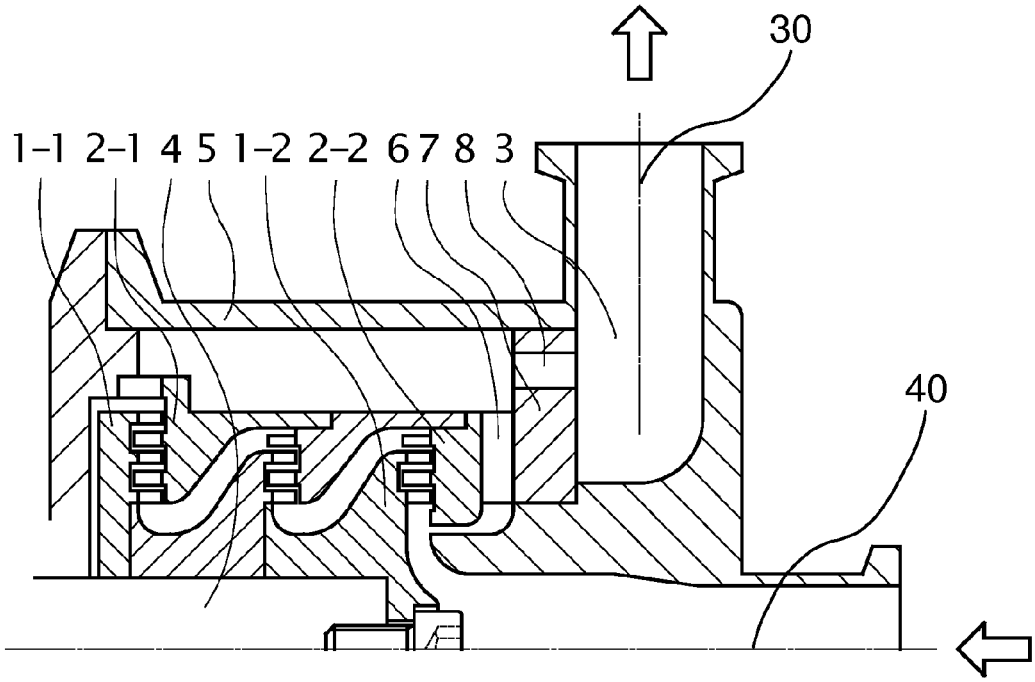
FIG. 5 is a structural view illustrating placement of a barrier shelf in the present invention.

The handled material inside the casing 5 rotates toward the outlet 3 with different rotating diameters, according to different specific gravities of the particles. As shown in FIG. 5, the present invention is designed so as to move the outlet 3 prior to the flow channel 6, while setting a barrier shelf 7 between the flow channel 6 and the outlet 3. Most importantly, a gradual pore 8, which is set at a different place in the barrier shelf 7, will allow only a material having a set fineness to run therethrough, while the remaining material still undergoes agitation and dispersion after being redirected via the flow channel 6.

INDUSTRIAL APPLICABILITY

According to the above-described inner-circulation structure, the pressure that occurs in the casing 5 can effectively be controlled without the need for supplying cooling water for the mechanical seal from a supercharging pump, irrespective of whether the stages of the rotor are increased or the rotation rate is increased. Also, the handled material undergoes reagitation and redispersion after running back via the flow channel 6, thereby achieving improved dispersion characteristics.

Furthermore, placement of the barrier shelf 7 and the gradual pore 8 permit only materials having a certain fineness to run therethrough, while the remaining material undergoes reagitation and redispersion. The arrangement thus enjoys a function of graduation, in order to improve the dispersion characteristics.

DESCRIPTION OF REFERENCE NUMBERS CHARACTERS

1 rotor
1-1 last rotor
1-2 first rotor
2 stator
2-1 last stator
2-2 first stator
3 outlet
4 shaft
5 casing
6 flow channel
7 barrier shelf
8 gradual pore
9 check valve
10 rotor outshoot
15 aperture
20 stator outshoot
30 outlet axis
40 shaft axis

What is claimed is:

1. A rotary emulsifying and dispersing arrangement comprising:
- a casing situated firmly on a base;
- a fixed stator with a first stator portion and a second stator portion;
- a chamber located between said casing and said fixed stator;
- a freely turnable shaft having a shaft axis; and
- a first rotor and a second rotor that rotate with said shaft, the first stator portion and the first rotor constituting a first pair;
- wherein a handled material, which is radially discharged from said second rotor, is redirected into a suction inlet via a flow channel, said flow channel runs from said chamber through said fixed stator to a position located between the shaft axis and the first pair.

2. The rotary emulsifying and dispersing arrangement according to claim 1, wherein a check valve is disposed in said flow channel.

3. The rotary emulsifying and dispersing arrangement according to claim 2, wherein a barrier shelf is disposed between said flow channel and an outlet positioned before said flow channel, and wherein a gradual pore allows only a filtered material having a predetermined fineness to run therethrough, while a remaining material, which is not of said predetermined fineness, undergoes reagitation and redispersion via said flow channel.

4. The rotary emulsifying and dispersing arrangement according to claim 1, wherein a barrier shelf is disposed between said flow channel and an outlet positioned before said flow channel, and wherein a gradual pore allows only a filtered material having a predetermined fineness to run therethrough, while a remaining material, which is not of said predetermined fineness, undergoes reagitation and redispersion via said flow channel.

5. The rotary emulsifying and dispersing arrangement according to claim 1, wherein said second rotor disperses said handled material into said chamber.

6. A fluid mixing device, comprising:
- a housing;
- a shaft capable of rotating about a shaft axis;
- an inlet where fluid can enter the housing;
- a stator having a first stator portion and a second stator portion;
- a chamber located between the housing and the stator;
- a first rotor and a second rotor capable of rotating with the shaft, the first stator portion and the first rotor constituting a first pair;
- an outlet where the fluid can leave the housing and the chamber; and
- a flow channel capable of directing the fluid from the chamber to a position located between the shaft axis and the first pair.

7. The fluid mixing device as claimed in claim 6 wherein the second rotor is capable of radially dispersing the fluid directly into the chamber.

8. The fluid mixing device as claimed in claim 7, further comprising:
- a filter between the chamber and the outlet.

9. The fluid mixing device as claimed in claim 7, further comprising:
- a barrier shelf with at least one gradual pore;
- wherein the barrier shelf is located between the chamber and the outlet.

10. The fluid mixing device as claimed in claim 9 wherein the barrier shelf forms a first channel side of the flow channel and the first stator portion forms a second channel side of the flow channel.

11. The fluid mixing device as claimed in claim 6, further comprising:
- a check valve provided in the flow channel.

12. The fluid mixing device as claimed in claim 11, further comprising:
- a filter between the chamber and the outlet.

13. The fluid mixing device as claimed in claim 11, further comprising:
- a barrier shelf with at least one gradual pore;
- wherein the barrier shelf is located between the chamber and the outlet.

14. The fluid mixing device as claimed in claim 13 wherein the barrier shelf forms a first channel side of the flow channel and the first stator portion forms a second channel side of the flow channel.

15. The fluid mixing device as claimed in claim 14 wherein the second rotor is capable of radially dispersing the fluid directly into the chamber.

16. The fluid mixing device as claimed in claim 6, further comprising:
- an aperture between the first rotor and the fixed stator, the aperture extending radially from the shaft axis; and
- a first passage formed on a first passage side by the first rotor and on a second passage side by the first stator portion;
- wherein stator outshoots of the first stator portion extend against the first rotor in a direction generally parallel with the shaft axis; rotor outshoots of the first rotor extend against the first stator portion in a direction generally parallel with the shaft axis; and the fluid passes through the first passage before being radially dispersed by the second rotor directly into the chamber.

17. The fluid mixing device as claimed in claim 16, further comprising:

a barrier shelf with at least one gradual pore;

wherein the barrier shelf is located between the chamber and the outlet.

18. The fluid mixing device as claimed in claim 17 wherein the barrier shelf forms a first channel side of the flow channel and the first stator portion forms a second channel side of the flow channel.

19. A rotary emulsifying and dispersing arrangement comprising:

a casing situated firmly on a base;

a freely turnable shaft having a shaft axis;

a fixed stator with a first stator portion and a second stator portion, the first stator portion having a plurality of stator outshoots;

a chamber located between said casing and said fixed stator;

a first rotor and a second rotor that rotate with said shaft, the first rotor having a plurality of rotor outshoots; and an aperture between the first rotor and the fixed stator, the aperture extending radially from the shaft axis;

wherein the stator outshoots extend against the first rotor in a direction generally parallel with the shaft axis; the rotor outshoots extend against the first stator portion in a direction generally parallel with the shaft axis; and a handled material, which is radially discharged from said second rotor, is redirected into a suction inlet via a flow channel, said flow channel runs from said chamber through said fixed stator before said first stator portion.

20. The fluid mixing device as claimed in claim 19 wherein a check valve is disposed in said flow channel.

* * * * *